US011020737B2

(12) United States Patent
Cowieson et al.

(10) Patent No.: US 11,020,737 B2
(45) Date of Patent: Jun. 1, 2021

(54) CHIP IN A TIP

(71) Applicant: Porvair Filtration Group Limited, Fareham (GB)

(72) Inventors: David Richard Cowieson, Wrexham (GB); Samantha Jane Hutchinson, Shropshire (GB); Lewis Francis, Swansea (GB)

(73) Assignee: Porvair Filtration Group Limited, Fareham (GB)

( * ) Notice: Subject to any disclaimer, the term of this patent is extended or adjusted under 35 U.S.C. 154(b) by 0 days.

(21) Appl. No.: 16/591,068

(22) Filed: Oct. 2, 2019

(65) Prior Publication Data

US 2020/0030788 A1 Jan. 30, 2020

Related U.S. Application Data

(63) Continuation of application No. 15/515,412, filed as application No. PCT/GB2015/053619 on Nov. 27, 2015, now Pat. No. 10,471,423.

(30) Foreign Application Priority Data

Nov. 28, 2014 (GB) ..... 1421197

(51) Int. Cl.
*B01L 3/02* (2006.01)

(52) U.S. Cl.
CPC ..... *B01L 3/0275* (2013.01); *B01L 2200/0631* (2013.01); *B01L 2300/0681* (2013.01)

(58) Field of Classification Search
CPC .. G01N 1/40; G01N 30/30; G01N 2030/0075; G01N 2030/009; G01N 30/60; B01L 3/02; B01L 3/021
See application file for complete search history.

(56) References Cited

U.S. PATENT DOCUMENTS 5,079,170 A 1/1992 Rosman et al.
7,846,333 B2 12/2010 Pluester et al.
9,523,681 B2 12/2016 Chernukhin et al.
(Continued)

FOREIGN PATENT DOCUMENTS

EP 1533015 A1 5/2005
GB 2369796 A 6/2002
(Continued)

OTHER PUBLICATIONS

Chromatrap, "Chromatrap® Pro-A Spin Columns, A Solid State Chromatin Immunoprecipitation Assay (ChIP)," 12 pages (2011).
(Continued)

*Primary Examiner* — Sally A Merkling
(74) *Attorney, Agent, or Firm* — Marshall, Gerstein & Borun LLP

(57) ABSTRACT

A pipette tip (20) containing a rigid porous matrix (22) on which a ligand is immobilized, the ligand being capable of binding to a protein associated with chromatin; the rigid porous matrix being positioned within the pipette tip such that, in use, chromatin in a liquid sample passing through the pipette tip is retained by the rigid porous matrix is described. A method of isolating chromatin from the liquid sample using the pipette tip and the use of the pipette tip in a chromatin immunoprecipitation assay are also described.

14 Claims, 3 Drawing Sheets

(56) References Cited

U.S. PATENT DOCUMENTS

| | | | | |
|---|---|---|---|---|
| 2002/0064413 | A1 | 5/2002 | Cowieson | |
| 2006/0124551 | A1 | 6/2006 | Gjerde et al. | |
| 2008/0119637 | A1 | 5/2008 | Gjerde et al. | |
| 2010/0009845 | A1 | 1/2010 | Bonn et al. | |
| 2010/0047921 | A1* | 2/2010 | Suzuki | C12N 15/1006 436/178 |
| 2011/0107855 | A1 | 5/2011 | Motadel | |
| 2012/0164750 | A1 | 6/2012 | Gjerde et al. | |
| 2014/0199780 | A1 | 7/2014 | Chernukhin et al. | |

FOREIGN PATENT DOCUMENTS

| | | | | |
|---|---|---|---|---|
| GB | WO-2012076882 | * | 6/2012 | B01D 15/3809 |
| WO | WO-2005/018803 | A1 | 3/2005 | |
| WO | WO-2012/076882 | A1 | 6/2012 | |

OTHER PUBLICATIONS

Combined Search and Examination Report, Great Britain Patent Application No. GB1421197.3, dated May 20, 2015.

Chinese Patent Application No. 201580060570.2, Search Report, dated Oct. 23, 2018.

Chinese Patent Application No. 201580060570.2, First Office Action and Search Report, dated Nov. 5, 2018.

Das et al., "Chromatin Immunoprecipitation Assay," *BioTechniques*, 37(6):961-69 (Dec. 2004).

Dahl et al., A rapid micro chromatin immunoprecipitation assay (μChIP), Nature Protocols, 3(6):1032-45 (2008).

Igor Chernukhin et al., "BioVyon Protein A, an alternative solid-phase affinity matrix for chromatin immunoprecipitation," Analytical Biochemistry, 412: 183-188 (2011).

International Search Report and Written Opinion, International Application No. PCT/GB2015/053619, dated Feb. 23, 2016.

International Preliminary Report on Patentability and Written Opinion of the International Searching Authority in International Application No. PCT/GB2015/053619, dated May 30, 2017 (6 pgs.).

Marguet et al., Protection of DNA by salts against thermodegradation at temperatures typical for hyperthermophiles, Extremophiles, 2:115-22 (1998).

O'Neill et al., Immunoprecipitation of native chromatin: NChIP, Methods, 31:76-82 (2003).

* cited by examiner

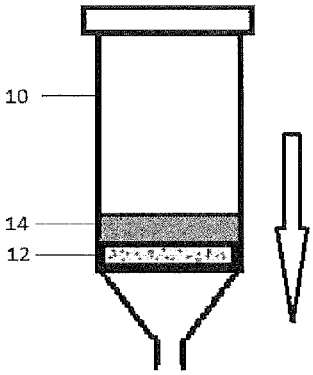
Fig.1A (Prior art)
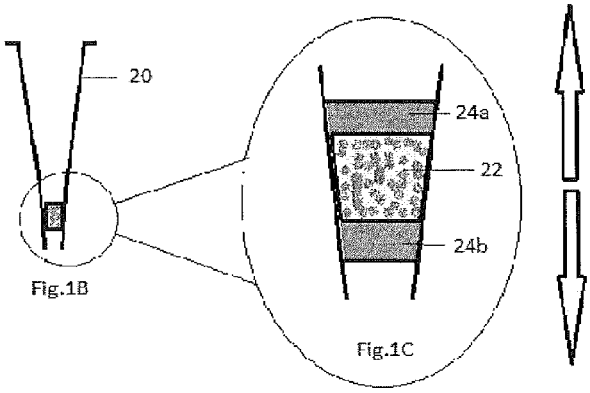
Fig.1B
Fig.1C

CHIP IN A TIP

CROSS-REFERENCE TO RELATED APPLICATIONS

This is a continuation of co-pending U.S. patent application Ser. No. 15/515,412, which is the U.S. national phase of international application No. PCT/GB2015/053619 filed Nov. 27, 2015, which claims priority to British patent application No. 1421197.3 filed Nov. 28, 2014, the disclosures of each of which are incorporated herein by reference in their entireties.

FIELD OF THE INVENTION

The present invention relates to a pipette tip, and an extraction method (such as a chromatin immunoprecipitation assay method) using the tip.

BACKGROUND TO THE INVENTION

Chromatin immunoprecipitation (ChIP) is an important technique used in the study of DNA/protein interactions. An advantage of ChIP is that it can be used for analysing the association of specific proteins, or their modified isoforms, with defined genomic regions. A review of existing ChIP technology is provided in O'Neill et al. (2003) "Immunoprecipitation of native chromatin, NChIP", Methods: A Companion to Methods in Enzymology 31:76-82. ChIP may be used to determine whether proteins such as transcription factors and modified histones bind to a particular region on the endogenous chromatin of living cells or tissues.

In a ChIP assay, fragments of the DNA-protein complex (i.e. the chromatin) are prepared in such a way so as to retain the specific DNA-protein interactions. These chromatin fragments can then be immunoprecipitated using an antibody against the protein present in the complex. The isolated chromatin fraction can then be treated to separate the DNA and protein components. The identity of DNA fragments isolated in connection with a particular protein (i.e. the protein against which the antibody used for immunoprecipitation was directed) can then be determined by Polymerase Chain Reaction (PCR), Real Time PCR (qPCR), hybridization on microarrays, direct sequencing or other technologies used for identification of DNA fragments of defined sequence.

Hence, a chromatin immunoprecipitation assay typically involves the following five key steps: (i) preparation of chromatin to be analysed from cells; (ii) immunoprecipitation of chromatin using an antibody; (iii) isolation of the precipitated chromatin fragments; (iv) DNA recovery from the precipitated product; and (v) DNA analysis.

The ChIP technique has two major variants that differ primarily in how the starting (input) chromatin is prepared. The first variant (designated NChIP) uses native chromatin prepared by micrococcal nuclease digestion of cell nuclei by standard procedures. The second variant (designated XChIP) uses chromatin cross-linked by addition of formaldehyde to growing cells, prior to fragmentation of chromatin, usually by sonication. Some workers have used mild formaldehyde cross-linking followed by nuclease digestion, and UV irradiation has been successfully employed as an alternative cross-linking technique.

Typically the immunoprecipitation of chromatin fragments is performed using an antibody specific to the protein of interest which is bound to DNA. The antibody-bound chromatin fragments may be isolated from the sample using a solid phase. WO 2012/076882 describes a separation column comprising a chamber for holding a liquid sample comprising chromatin, and a rigid porous matrix on which a ligand is immobilized, wherein the ligand is capable of binding to a protein associated with the chromatin. In use, the liquid sample may first be added to a chamber in a separation column, e.g. through an upper opening in the column. The liquid sample may then pass through a rigid porous matrix, typically positioned above an effluent port at a lower end of the column, and thereby exit the column. In this way, chromatin fragments present in the liquid sample can bind to the ligand whilst passing through the matrix. Chromatin fragments are thereby separated from the liquid sample, which may then be discarded.

However, when the apparatus described in WO 2012/076882 is used, especially in a spin column, in order to obtain the necessary contact between the chromatin and the ligand on the rigid porous matrix to secure its retention to the matrix, it is necessary for the liquid sample containing the chromatin to be added in a volume such that it is completely absorbed by the matrix, i.e. the liquid sample must be retained within the internal void space of the matrix. Any volume of the liquid sample which exceeds the void volume of the matrix will not be able to contact the functional groups on the ligand.

At the publication date of WO 2012/076882, it was thought the apparatus could operate on liquid sample roughly equal to the internal void volume of the rigid porous matrix. However, subsequent to the publication of WO 2012/076882, the present inventors have found that, in practice, when used in a spin column, the amount of liquid sample is restricted to around 2-3 times the void volume of the rigid porous matrix to ensure adequate chromatin recovery. For example, in a standard spin column where the void volume is about 40 μl, the apparatus is typically restricted to chromatin-containing liquid sample volumes of a maximum of 100 μl.

A further drawback of the apparatus described in WO 2012/076882 is that it is generally necessary in practice to draw the liquid sample through the matrix by centrifugation: multiple centrifugation processes are typically required. This frequently requires complex and expensive machinery, such as robot arms, to carry out the method, particularly when used for assays involving multi-well plates.

Pipettes are laboratory tools commonly used in a wide variety of scientific fields to transport a measured volume of liquid, often as a media dispenser. Typically, pipettes work by creating a partial vacuum above the liquid-holding chamber such that reduced pressure causes the liquid sample to be drawn into the pipette and selectively releasing this vacuum (i.e. increasing the pressure) to expulse the liquid.

US 2008/0119637 describes a pipette tip column comprised of a packed bed of gel resin, wherein the packed bed of gel resin is comprised of agarose or sepharose, and wherein the gel resin is further comprised of an affinity group having an affinity for the protein analyte, and wherein said gel resin lacks residual ion exchange groups. The agarose gel is held between two frits in the tip. The protein analyte may be extracted by passing a sample solution through the pipette tip column. Agarose gels are prone to non-specific binding of DNA and proteins, and it is difficult to provide adequate washing steps to reduce the resulting background signal. These disadvantages are also encountered when the agarose gel forms part of an extraction system in a pipette tip.

US 2010/0009845 describes a pipette tip which is fitted with a porous organic monolith which is doped with active particles. The tip can be used as a tool for solid phase extraction, especially for desalting, isolating and purifying biomolecules such as peptides and proteins. According to the process described in this document, polymerisation may take place in situ, so that the product must be custom made for each application or has to be made by the user. Using this process, it would also be difficult to achieve reproducibility between the monoliths.

The application of reduced pressure to draw in a liquid sample and increasing the pressure to expulse the liquid can avoid the need for centrifugation. However, when this process is carried out in a standard size separation column with a standard sized frit of the type described generally in WO 2012/076882, driving the liquid through the column using reduced or increased pressure can cause foaming. This foaming can cause contamination or loss of sample and can block further liquid passage.

Pipette tips having filtration apparatus, such as fits disposed therein are generally known in the art. However, in the known pipette tips, the filtration apparatus is typically positioned in the top half of the tip, close to the point where the tip engages the main body of the pipette. The function of such apparatus is generally to prevent liquid from entering the aspiration means for drawing the liquid in and protect this equipment, rather than to capture an analyte such as chromatin present in the liquid.

Some known pipette tips such as the ZipTip® manufactured by Merck Millipore have filtration or analyte capture means disposed in the lower half of the tip. However, these generally comprise fibrous material with general sorbents such as C8 or C18 modified silica. Pipette tips containing chromatin-specific capture matrices have not previously been disclosed in the art.

Thus there is a need for improved chromatin immunoprecipitation assay apparatus and methods which address one or more of the above problems.

SUMMARY OF THE INVENTION

In one aspect of the invention, there is provided a pipette tip having:

an open upper end adapted to engage a pipette;

an open lower end; and a through passageway in fluid communication with the upper and lower ends;

the pipette tip being configured such that, in use, a liquid sample is capable of passing through the tip both by being drawn in through the lower end by the application of reduced pressure, and being expulsed out of the lower end by the application of increased pressure;

the pipette tip containing a rigid porous matrix on which a ligand is immobilized, the ligand being capable of binding to a protein associated with chromatin;

the rigid porous matrix being positioned within the pipette tip such that, in use, chromatin in a liquid sample passing through the pipette tip is retained by the rigid porous matrix.

In another aspect, there is provided a pipette (or other extraction apparatus) provided with a tip according to the invention.

In a further aspect, there is provided a method of isolating chromatin from a liquid sample, the method comprising passing the liquid sample through a pipette tip according to the invention or a pipette (or other extraction apparatus) according to the invention, such that the chromatin is retained on the rigid porous matrix in the pipette tip.

In a yet further aspect, there is provided a method of performing a chromatin immunoprecipitation assay, comprising the steps of:

(i) preparation of a liquid sample comprising chromatin to be analysed from cells;

(ii) immunoprecipitation of the chromatin in the liquid sample onto a rigid porous matrix to which a ligand is immobilised according to the method of the invention;

(iii) DNA recovery from the precipitated chromatin; and (iv) DNA analysis.

In a still further aspect, there is provided a kit comprising a pipette tip according to the invention or a pipette according to the invention, and one or more buffers, solutions or reagents suitable for performing a chromatin immunoprecipitation assay.

In a still further aspect, there is provided use of a pipette tip of the invention, or a pipette (or other extraction apparatus) according to the invention for isolating chromatin from a liquid sample, and particularly in a chromatin immunoprecipitation assay.

Advantages and Surprising Findings

The apparatus and method of the invention confers a number of advantages over the prior art. In particular, the apparatus and method of the present invention does not require the use of centrifugal force to drive buffers and reagents through the rigid porous matrix, thereby allowing much easier automation (or even manual operation) and avoiding the requirement for expensive automation equipment.

In addition, when compared with the apparatus and methods described generally in WO 2012/076882, the apparatus and method of the invention significantly reduces the incubation times associated with the immunoprecipitation process, reducing the time to carry it out from hours to minutes. Furthermore, the apparatus and method of the invention significantly improves the effectiveness of the wash steps during the immunoprecipitation process.

The apparatus and method of the invention confers the additional advantage in that the loading chromatin onto the rigid porous matrix can be achieved from much larger volumes of chromatin-containing solutions when compared with the apparatus and methods described generally in WO 2012/076882. Furthermore, more intimate contact of the chromatin with the rigid porous matrix of the apparatus of the invention improves the sensitivity of the device making it possible to utilise much smaller amounts of chromatin compared to competing devices. According to the method of the invention, a dilute chromatin solution many times the pore volume of the frit can be drawn back and forth across the rigid porous matrix of the apparatus to maximise the adsorption of chromatin from the solution. Furthermore, loading chromatin from a large volume of dilute chromatin solution and then removing it from the frit using a smaller volume of eluent allows for significant enrichment of the chromatin concentration in the eluate compared with the methods described generally in WO 2012/076882.

In particular, the method of the present invention, while having a much shorter protocol at the immunoprecipitation stage than standard ChIP methods and still gives good ChIP results over a range of chromatin additions. Unexpectedly, the much shorter contact time of the lysate with the functionalised porous matrix in the method of the present invention has not negatively affected the binding efficiency of the chromatin to the ligand immobilised on the rigid porous matrix: surprisingly, this gives better results than the method described generally in WO 2012/076882.

Without wishing to be bound by theory, it is believed the multiple movements of the liquid sample through the rigid porous matrix, in the method of the present invention, may enhance the binding of the chromatin to the rigid porous matrix by replenishing the chromatin/antibody available at the inner surfaces of the rigid porous matrix as the liquid is moved. In contrast, in the method described generally in WO 2012/076882, the lysate is added to the rigid porous matrix to simply fill the pore volume and relies on diffusion only to provide the necessary contact.

The apparatus and method also confers the advantage of concentrating the chromatin in the final eluent. When used in a chromatin immunoprecipitation assay, carrying out the method in a pipette tip incorporating a rigid porous matrix according to the invention allows the user to work with larger volumes of chromatin containing solutions in the loading phase of the assay. Following the loading, if in the final elution stage a smaller volume of eluent is used, it is possible to achieve both a concentration effect and increased sensitivity. This confers an advantage over the standard spin column approach described generally in WO 2012/076882 because the problem of the restriction of the load volume is overcome.

Surprisingly, when the method of the present invention was directly compared to the method described generally in WO 2012/076882 (utilising the same batch and size of frits) the results were improved with higher % antibody results for a much shorter protocol. The agarose gel tip (Purespeed™ Pro A), which employs technology generally described in US 2008/0119637, failed to show a signal in this test.

BRIEF DESCRIPTION OF THE FIGURES

FIG. 1A illustrates a spin column provided with a frit according to the prior art;

FIG. 1B illustrates a pipette tip according to the invention;

FIG. 1C is an expanded view of FIG. 1B;

DETAILED DESCRIPTION

Pipette Tip

Figure 2:
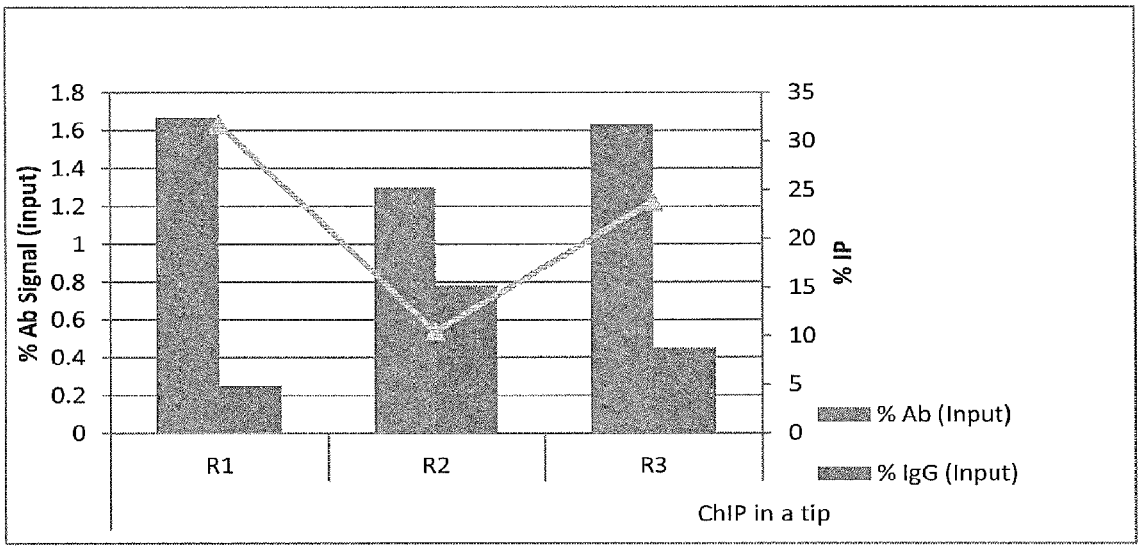
FIG. 2 illustrates the % Ab signal for a chromatin-containing sample passing through 3.5 mm fits in a 200 μl pipette tip according to the invention.

One aspect of the apparatus of the present invention comprises a pipette tip. The tip has an open upper end adapted to engage a pipette (or other like extraction apparatus, such as those defined and exemplified below, including but not limited to a syringe); an open lower end; and a through passageway in fluid communication with the upper and lower ends. The pipette tip is configured such that, in use, a liquid sample is capable of passing through the tip in both directions, typically by being drawn in through the lower end by the application of reduced pressure (such as by application of vacuum), and being expulsed out of the lower end by the application of increased pressure. The pipette tip contains a functionalised, rigid porous matrix, described in more detail below.

Typically, the cross-sectional area (particularly when viewed in horizontal cross-section) of the pipette tip narrows from the upper end towards the lower end thereof. In one embodiment, the pipette tip is tapered towards the lower end thereof. Particular examples of pipette tips include those having a frusto-conical or frusto-pyramidal shape.

The pipette tip has an upper end which is adapted to engage a pipette or similar extraction apparatus. In one embodiment, the tip is an integral part of the pipette. In another embodiment, the tip is manufactured separately from the pipette and attached to the pipette prior to use.

The pipette may be any pipette or like extraction apparatus known in the art, provided that during operation thereof, a liquid sample is capable of passing in both directions through the tip, for example both by being drawn in through the lower end by the application of reduced pressure and being expulsed out of the lower end by the application of increased pressure. Examples of pipettes and like extraction apparatus well known to the person skilled in the art include an air displacement pipette, a positive displacement pipette, a pipetting syringe, a glass micropipette, a microfluidic pipette, a multichannel pipette, a microsyringe, a syringe and a cannula. Positive displacement pipettes are particularly preferred for the present invention because the disposable tip contains the plunger. This essentially allows the device to operate like a micro-syringe where the plunger directly displaces the liquid, providing the potential for the device to operate without air entering the rigid porous matrix.

The volume of the pipette tip may vary depending on the assay to be carried out, the rigid porous matrix to be included, and the amount of liquid sample which is intended to pass through it. In one particular example, the pipette tip is of a volume ranging from 1 μl to 10 ml, such as 5 μl to 1 ml, such as 10 μl to 500 μl, such as 20 to 200 μl, such as 40 to 100 μl.

The pipette tip contains a rigid porous matrix disposed within the pipette tip. The rigid porous matrix is functionalised in order to bind to an analyte (typically a protein associated with chromatin) in the liquid sample during operation of the apparatus. The rigid porous matrix is described in more detail below.

The rigid porous matrix is positioned within the pipette tip such that, in use, an analyte (typically chromatin) in a liquid sample passing through the pipette tip is retained by the rigid porous matrix (typically by a ligand being capable of binding to a protein associated with chromatin, the ligand being immobilized on the rigid porous matrix). Typically, the rigid porous matrix is disposed within the pipette tip such that it covers substantially the entire cross-sectional area of the pipette tip.

The rigid porous matrix may be positioned within the pipette tip such that, in use, the liquid sample is capable of a single pass through the tip, by a single drawing through the lower end and a single expulsion out of the lower end. However, it is preferred according to the present invention that the rigid porous matrix is positioned within the pipette tip such that, in use, the liquid sample is capable of multiple passes through the tip, by multiple drawings through the lower end and multiple expulsions out of the lower end. This confers a number of advantages over the prior art. The ability to draw the liquid sample containing analyte (typically chromatin) up and down through the rigid porous matrix multiple times increases the amount of potential contact between the functionalization on the rigid porous matrix and the analyte (typically chromatin). This maximises the use of the functionality on the rigid porous matrix, thereby solving the problem of the restriction on sample volume compared to the apparatus and methods described generally in WO 2012/076882. Surprisingly, this also contributes to a significant reduction of incubation period from the order of 1 hour to a few minutes during which time the chromatin in a much larger amount of solution can be bound onto the rigid porous matrix.

In one embodiment, the rigid porous matrix is positioned within the pipette tip such that, in use, the proportion of liquid below the rigid porous matrix is less than 50% (such as less than 40%, such as less than 30%, such as less than 20%, such as less than 10%, such as less than 5%, such as less than 3%, such as less than 2%, such as less than 1%) of the total volume of liquid in the tip. Typically, this is done by positioning the rigid porous matrix in the lower half, preferably the lowest quarter, of the tip. In one embodiment, the rigid porous matrix is disposed near or at the lower end of the tip. It is particularly advantageous to position the rigid porous matrix within the pipette tip so as to minimise the proportion of liquid below the rigid porous matrix in use, as this maximises the liquid content passing through the rigid porous matrix with each draw in and expulsion of liquid and increases the ability for the ligands to bind the chromatin with each pass.

Rigid Porous Matrix

The pipette tip of the present invention contains a rigid porous matrix. In the method of the present invention, the liquid sample comprising chromatin, optionally bound by an antibody, is passed through the rigid porous matrix such that the chromatin, or antibody-bound chromatin, is retained by the rigid porous matrix.

The matrix will in general be porous, i.e. pores or spaces will be present within the matrix through which liquids may pass. The matrix of the invention may take any convenient physical form, for example sheets, filters, membranes, cylinders, fibres or tubes. In one preferred embodiment, the matrix comprises a filter, disc or frit. The matrix typically functions as an adsorbent (i.e. by binding the protein associated with chromatin by virtue of the ligand on its surface). Thus whilst in some embodiments the matrix may be in the physical form of a filter (e.g. a disc or frit), the matrix need not function as a typical filter. In one embodiment, the matrix comprises an adsorbent disc or frit.

The rigid porous matrix, such as a disc or frit, is dimensioned so as to fit within the pipette tip, typically occupying the entire cross-sectional area of the pipette tip. The precise shape and dimensions of the disc or frit depend on those of the pipette tip. However, in one embodiment, the disc or frit is circular or polygonal in cross-section. In one particular example, the disc or frit is of a diameter ranging from 0.01 mm to 2 cm, such as 0.1 mm to 2 cm, such as 0.5 mm to 1 cm, such as 1 to 8 mm, such as 2 to 5 mm or 5 to 8 mm.

The thickness of the rigid porous matrix, such as a disc or frit, may vary depending on the amount of functionalised material, such as ligand, necessary to bind the analyte, such as chromatin, present in the sample, and the dimensions of the pipette tip in which it fits. In one particular example, the disc or frit is of a thickness ranging from 0.01 mm to 2 cm, such as 0.1 mm to 2 cm, such as 0.5 mm to 1 cm, such as 1 to 8 mm, such as 1 to 4 mm.

In one particular example, ChIP assays were carried out using a small Protein A frit, 3.5 mm diameter×2 mm thickness, inserted into a 200 μl pipette tip or a Protein A frit, 7.4 mm diameter×2 mm thickness, inserted in a modified spin column.

In one embodiment, the rigid porous matrix comprises sintered thermoplastic polymer particles. Particular examples of suitable matrices are described in WO 2005/018803. The matrix may have a modified surface which is chemically reactive or functionalized, e.g. which provides pendant functional groups which are suitable for attaching the ligand, optionally via a linker. The matrices of the invention are essentially rigid.

As used herein, the term "polymer" generally includes, but is not limited to, homopolymers, copolymers, such as for example, block, graft, random and alternating copolymers, terpolymers, etc., and blends and modifications thereof. In addition, unless otherwise specifically limited, the term "polymer" also includes all possible geometric configurations of the molecule. These configurations include, inter alia, isotactic, syndiotactic, atactic and random symmetries.

The polymer used in the process and materials of the invention is typically a thermoplastic polymer. A thermoplastic, also known as a thermosoftening plastic, is a polymer that becomes pliable or mouldable above a specific temperature, and returns to a solid state upon cooling.

The polymer used in the process and materials of the invention is typically an organic polymer. A large number of organic polymers are known in the art. Examples of particular classes of organic polymers suitable for use according to the present invention include polyolefins, polyesters, polycarbonates, polyamides, polyimides, polyether sulfones, and mixtures or derivatives thereof.

In one embodiment, the organic polymer is a polymer formed by polymerising an ethylenically unsaturated monomer (i.e. a compound having a C=C bond). In one embodiment, the ethylenically unsaturated monomer may be an olefin: in other words, an unsubstituted, unsaturated hydrocarbon (such as ethylene, propylene, 1-butene, 1-hexene, 4-methyl-1-pentene or styrene). In this specification polymers formed by polymerising such monomers are termed 'polyolefins'. In another embodiment, the ethylenically unsaturated monomer is an ethylenically unsaturated hydrocarbon substituted with one or more halogen atoms, particularly one or more fluorine atoms (such as vinylidene fluoride or tetrafluoroethylene), or an ethylenically unsaturated hydrocarbon substituted with another substituent which, following polymerisation, is inert to the sorbent material. In this specification polymers formed by polymerising such monomers are termed 'substituted polyolefins'.

In one embodiment, the thermoplastic organic polymer is selected from the group consisting of a polyolefin and a substituted polyolefin. Examples of suitable polyolefins include, but are not limited to: polyethylenes; polypropylenes; poly(1-butene); poly(1-pentene); poly(1-hexene); poly (methyl pentene); polystyrene; and mixtures thereof. Examples of suitable substituted polyolefins include, but are not limited to: poly(vinylidene fluoride); poly(tetrafluoroethylene) (PTFE-Teflon®); poly(methyl methacrylate); and mixtures thereof. Preferably, the thermoplastic organic polymer is selected from the group consisting of polyethylene and polypropylene.

In one embodiment, the polyolefin is polyethylene. Polyethylene is typically characterised by its density and linearity. Very low density polyethylene (VLDPE), low density polyethylene (LDPE), linear low density polyethylene (LLDPE), medium density polyethylene (MDPE) and high density polyethylene (HDPE) and ultra high molecular weight polyethylene (UHMWPE) may all be used in the present invention. UHMWPE is polyethylene with a molecular weight numbering in the millions, usually between 3.1 and 5.67 million. It typically has a density of 0.930-0.935 g/cm$^3$. HDPE is defined by a density of greater or equal to 0.941 g/cm$^3$. MDPE is defined by a density range of 0.926-0.940 g/cm$^3$. LLDPE is defined by a density range of 0.915-0.925 g/cm$^3$. LLDPE is a substantially linear polymer with significant numbers of short branches, commonly made by copolymerization of ethylene with short-chain alpha-olefins (for example, 1-butene, 1-hexene and 1-octene). LDPE is defined by a density range of 0.910-0.940 g/cm$^3$. VLDPE is defined by a density range of 0.880-0.915 g/cm$^3$. VLDPE is a substantially linear polymer with high levels of short-chain branches, commonly made by copolymerization of ethylene with short-chain alpha-olefins (for example, 1-butene, 1-hexene and 1-octene). All of the above forms of polyethylene can be prepared by standard techniques well known to those skilled in the art.

In one embodiment, the polyolefin is polypropylene. The polypropylene may be stereoregular (isotactic or syndiotactic), atactic polypropylene, or a mixture thereof. All of the above forms of polypropylene can be prepared by standard techniques well known to those skilled in the art.

In one embodiment, the thermoplastic polymer is polyethylene; or a copolymer or blend which comprises polyethylene, preferably at least 80% polyethylene, particularly preferably at least 90% polyethylene and most preferably at least 95% polyethylene.

Examples of usable polyethylenes include high density polyethylene and ultra high molecular weight polyethylene, as used by Porvair Filtration Group Ltd, UK, in the manufacture of its products under the trade marks VYON® or BIOVYON®. The thermoplastic polymer may also comprise flow modifiers, additives, etc., as are usual in the art.

The thermoplastic polymer particles to be sintered to form the matrix will in general have a size in the range that is appropriate for the ultimate use of the matrix. The particles may be spherical, generally spherical or may be any other suitable regular or irregular shape. The person skilled in the art will appreciate that the rate of fluid passage through the matrix will be determined at least in part by the sizes of the particles which comprise the matrix and the conditions under which those particles are sintered. Other variables to be taken into account in this regard include the molecular size and other properties of any material which is linked to the matrix.

As used herein, the term "sintered thermoplastic polymer" refers to a number of thermoplastic polymer particles which generally have been coalesced into a single unit under the influence of heat and vibration, without actually liquefying the polymer. The matrix therefore comprises a plurality of fused thermoplastic polymer particles having a defined structure which is maintained upon the application of a fluid. The "sintered thermoplastic polymer" will also in general be essentially rigid due to the fused nature of the constituent particles, i.e. it will be essentially incompressible and it will not shrink or swell in aqueous solutions. However, some embodiments of the invention such as sheets or membranes which comprise the matrix of the invention may be flexible.

Methods of sintering thermoplastics are well known in the art. These include the methods disclosed in e.g. US2002/0064413 and GB 2369796.

The pore size of matrix post-sintering may be predetermined during its manufacture to be appropriate for the desired use. In general, the sizes of the pores in the matrix may be 1-1000 μm, such as 1-500 μm, such as 500-1000 μm, such as 200-700 μm, such as 5-100 μm, such as 5-20 μm such as 20-40 μm or 40-80 μm.

After sintering, the matrix is modified in order to provide a chemically-reactive surface, e. g. a functionalized surface, preferably an irregular surface. This modification increases the surface area of the matrix. It also provides functional groups on the surface which facilitate the attachment of the ligand. In other words, the chemically reactive surface is a modified surface which provides pendant functional groups which are suitable for attaching the ligand to the surface, optionally via a linker.

A number of techniques are known for the surface modification of thermoplastic polymers. Three preferred techniques which are usable in this regard are gas plasma amination, gamma-irradiation and chemical oxidation, as described in WO 2005/018803.

Preferably the matrix has a modified surface produced by chemical oxidation. Chemical oxidation techniques result in the creation of intermediate irregular reactive functions via the breaking of carbon bonds in the thermoplastic. Preferably, the surface of the matrix is modified by treatment with one or more oxidizing acids, e.g. an acid selected from the group consisting of trifluoroacetic acid, trifluoromethanesulfonic acid, chromium trioxide and sulfuric acid; optionally in the presence of a dichromate salt such as $K_2Cr_2O_7$.

A number of strategies have been commonly employed for the chemical oxidation of thermoplastics. If modification of the thermoplastic surface only is desired, this can be achieved by relatively mild chemical oxidation using a chromate or dichromate salt and acid such as $K_2Cr_2O_7$ in $H_2SO_4$, without causing significant damage to the physical structure of the surface. Physical erosion of the thermoplastic (tunnels and holes inside the plastic material to increase its binding capacity, prior to modification of the surface of the plastic material) can be achieved by treatment of the plastic with more aggressive acid such as trifluoroacetic acid applied at higher concentrations and higher temperatures.

The types of the functional groups that are present on the surface of the matrix depend on the type of the reaction that is employed to generate them. In most cases, carboxyl or hydroxyl groups are produced. Aldehyde and keto groups can also be generated as side products of the reaction. Carboxyl or hydroxyl functions can be substituted by more stable and potentially reactive functions, for instance, amines. Amino groups can be chemically introduced directly onto the thermoplastic surface or attached via spacer molecules (linkers).

After the surface of the matrix has been functionalized, the surface may be reacted with one or more linkers or spacers. The function of such entities is (i) to facilitate the attachment of a desired ligand to the surface of the matrix and/or (ii) if desired, to allow the ligand to be placed at a certain distance away from the surface of the matrix.

Advantageously, the modified surface remains chemically inert thus significantly reducing the non-specific background binding. Linker technology helps to preserve to a large extent the native conformation of any immobilized proteins, and also any proteins which are purified on such matrices. Utilization of a non-cleavable linker on the matrix allows permanent covalent coupling of the protein to the matrix thus radically reducing leaching of any immobilized molecules from the matrix.

Preferably, a linker is bound to the surface of the matrix. Most preferably, the linker is bound to the surface of the matrix immediately after the surface has been modified. The selection of an appropriate linker will be dependent on the surface functionalization of the matrix and the ligand intended to be bound to the matrix. Numerous such linkers are known in the art. In particular, reactions which may be employed for coupling polypeptide or DNA/RNA molecules to certain linkers or directly to solid supports are well known in the art. Conveniently, functional groups can be incorporated into a ligand during its chemical synthesis. Potential functional groups include ethers, esters, thiols, dialkylamides, hydrazides, diamines and many others. Appropriate linkers will be those that contain groups which are capable of reacting with one or more of the aforementioned functional groups. For example, a linker which utilizes the formation of a thioether bond between the ligand and the linker could have the thiol group on one (ligand) end and bromoacetyl group on the other (linker).

Typically the ligand which is immobilized on the matrix is a biological molecule, commonly a protein (for example, an antibody, protein A or protein G). It is important to preserve the activity of the biological molecule once it is bound to the matrix. This restricts the choice of linker strategies, because non-denaturing (i.e. physiological or mild) conditions must be used to link the protein to the linker. Not all linkers can be used under such conditions. The biological activity of a protein might be dependent on the accessibility (to a substrate) of a particular functional group; such groups must therefore not be used to link the protein to the matrix. Furthermore, many of the potential functional groups may be modified post-translationally (e.g. by phosphorylation, acetylation, etc.) and therefore will not be accessible for the linking reaction.

Preferred reactions for conjugation of biologically active molecules and linkers include:

1) Amino-linkage, or formation of an amide bond between a linker and a ligand (e.g. protein) via reaction between ester function at the linker's end and the protein's primary and/or secondary amines. Such reactions are generally reliable and the activity of the immobilized protein is very rarely affected. Furthermore, the reaction can be performed at neutral pH (for primary amines) rising to around pH 8.3 (for secondary amines). Furthermore, the reaction requires no free amines in the reaction mixture.

2) Thio-linkage, or formation of a covalent bond between a thiol present on the matrix and another thiol originating from the protein. In this reaction, the conjugation reaction is reversible, i.e. the ligand can be removed back into fluid phase after reduction with 2-mercaptoethanol or DTT. This can be very convenient for studying interactions between proteins, for example. The reaction requires some special condition for conjugation, i. e. the absence of divalent metals in the solution; and the protein must have SH-groups reduced prior to conjugation.

3) Carboxylic linkage, or formation of the covalent bond between the functional group on the matrix and carboxy-terminus of the protein. This type of reaction is less efficient and reliable because many proteins have C-termini which are naturally modified (i.e. blocked).

In one embodiment, a ligand which binds to a protein associated with chromatin is immobilized on the surface of the matrix. In this embodiment, post-sintering, the matrix is provided with a surface which is non-aminated or essentially non-aminated. In this method, after oxidation (and preferably immediately after oxidation), a spacer is generated in a reaction between a carboxyl function on the matrix and 6-aminohexanoic acid. This reaction produces a linker with the anchoring carboxylic function. Importantly, this approach does not involve generation of unbound amines on the surface, which significantly reduces the non-specific background binding to the modified surface.

The linker is preferably one which is long enough to prevent any steric hindrance between the support and the protein which binds to the ligand. Linkers may also be introduced to create a large enough distance between ligand attachment sites thus providing non-restricted access of the ligands to reagents and also preventing aggregation of the ligands on the surface of the polymer.

In conjugation of biologically active molecules, the length of the linker will determine the distance between the ligand and solid support. It has been shown that this length may significantly affect the functional activity of a biological molecule which is attached via the linker. Preferably, the linker will comprise from 3 to 11 carbon atoms, most preferably 3, 4, 5, 6, 7 or 8 carbon atoms. The linker may either be a cleavable linker or a non-cleavable linker. The term "cleavable linker" is intended to mean a linker that is cleavable under conditions which do not affect the activity of the ligand which is bound via the linker to the matrix.

The ligand which is attached to the matrix, optionally via a linker, may be any agent which binds to a protein associated with the chromatin. Typically the ligand is a protein, polypeptide, peptides, peptide mimetic, antibody or fragment thereof (e.g. monoclonal, polyclonal, Fab, scFv). Preferably the ligand comprises an agent which binds to an antibody, e.g. an anti-immunoglobulin (e.g. anti-IgG) antibody, protein A or protein G. Alternatively the ligand may comprise an antibody which binds to the protein of interest, e.g. the ligand may be an anti-histone antibody.

In one embodiment, the ligand is Protein A. Protein A is a 42 kDa surface protein originally found in the cell wall of the bacterium *Staphylococcus aureus*. It is encoded by the spa gene and its regulation is controlled by DNA topology, cellular osmolarity, and a two-component system called ArlS-ArlR. Protein A and its ability to bind immunoglobulins are well known to the person skilled in the art.

In one embodiment, the ligand is Protein G. As is known to the person skilled in the art, Protein G is an immunoglobulin-binding protein expressed in group C and G Streptococcal bacteria much like Protein A but with differing specificities. It is a 65-kDa (G148 protein G) and a 58 kDa (C40 protein G) cell surface protein that has found application in purifying antibodies through its binding to the Fab and Fc region.

In one aspect, the present invention relates to a method of isolating chromatin from a sample. By "isolating chromatin" it is typically meant that chromatin becomes bound to the matrix, e.g. such that it can be conveniently separated from the liquid sample.

Chromatin

Chromatin consists of a complex of DNA and protein (primarily histone), and makes up the chromosomes found in eukaryotic cells. Chromatin occurs in two states, euchromatin and heterochromatin, with different staining properties, and during cell division it coils and folds to form the metaphase chromosomes. Chromatin is used herein to refer to any such complex of nucleic acid (typically DNA) and associated proteins, including chromatin fragments produced by fragmentation of chromosomes or other chromatin preparations.

Chromatin Immunoprecipitation

Typically the method is performed as part of a chromatin immunoprecipitation (ChIP) assay. The term "chromatin immunoprecipitation assay" is well known to a skilled person, and preferably comprises at least the following steps:

(i) preparation of a liquid sample comprising chromatin to be analysed from cells;

(ii) immunoprecipitation of the chromatin in the liquid sample onto the matrix using an antibody;

(iii) DNA recovery from the precipitated chromatin;

(iv) DNA analysis.

The ChIP assay may be NChIP or XChIP as described above.

Sample

The liquid sample may be prepared from any biological source which comprises the analyte (typically chromatin), e.g. any preparation comprising cells. The cells may be derived from a tissue sample, or from cells grown in culture. Preferably the cells comprise mammalian cells, preferably human or mouse cells.

Typically, the method may be performed on a sample comprising chromatin from $10^3$ to $10^9$ cells, e.g. preferably less than $10^7$ cells, less than $10^6$ cells or less than $10^5$ cells, preferably about $10^4$ to $10^6$ cells. One cell typically contains about 6 pg ($6\times10^{-12}$ g) DNA per cell and equal amounts of DNA and protein in chromatin. Thus the method may be performed, for example, on a sample comprising about 0.6 μg DNA, or 1.2 μg of chromatin (this equates to mass of DNA or chromatin in about 100,000 cells).

Chromatin Preparation

In embodiments of the present invention, a preparation comprising cells is subjected to a chromatin immunoprecipitation assay (ChIP). Typically chromatin is first extracted from the preparation to prepare a liquid sample comprising chromatin fragments.

In one embodiment, cells are first harvested from the preparation using standard techniques, from which nuclei may then be obtained. For example, the cells may be disrupted (e.g. using a cell lysis buffer or sonication), which results in the nuclei being released there from. Following release of the nuclei, the method preferably comprises a step of digesting the nuclei in order to release the chromatin, for example using micrococcal nuclease or further sonication.

In another embodiment, the method may comprise a step of cross-linking the chromatin. This may be achieved for any suitable means, for example, by addition of a suitable cross-linking agent, such as formaldehyde, preferably prior to fragmentation of the chromatin. Fragmentation may be carried out by sonication. However, formaldehyde may be added after fragmentation, and then followed by nuclease digestion. Alternatively, UV irradiation may be employed as an alternative cross-linking technique.

In one embodiment, cells or tissue fragments are first fixed with formaldehyde to crosslink protein-DNA complex. Cells can be incubated with formaldehyde at room temperature or at 37° C. with gentle rocking for 5-20 min, preferably for 10 min. Tissue fragments may need a longer incubation time with formaldehyde, for example 10-30 min, e.g. 15 min. The concentration of formaldehyde can be from 0.5 to 10%, e.g. 1% (v/v).

Once crosslinking reaction is completed, an inhibitor of crosslink agents such as glycine at a molar concentration equal to crosslink agent can be used to stop the crosslinking reaction. An appropriate time for stopping the crosslinking reaction may range from 2-10 min, preferably about 5 min at room temperature. Cells can then be collected and lysed with a lyses buffer containing a sodium salt, EDTA, and detergents such as SDS. Tissue fragments can be homogenized before lysing.

Cells or the homogenized tissue mixture can then be mechanically or enzymatically sheared to yield an appropriate length of the DNA fragment. Usually, 200-1000 base pairs of sheared chromatin or DNA is required for the ChIP assay. Mechanical shearing of DNA can be performed by nebulization or sonication, preferably sonication. Enzymatic shearing of DNA can be performed by using DNAse I in the presence of Mn salt, or by using micrococcal nuclease in the presence of Mg salt to generate random DNA fragments. The conditions of crosslinked DNA shearing can be optimized based on cells, and sonicator equipment or digestion enzyme concentrations.

In one embodiment, once DNA shearing is completed, cell debris can be removed by centrifugation, and supernatant containing DNA-protein complex is collected. The result is a liquid sample comprising chromatin fragments in which the protein is immobilized on the DNA (e.g. wherein the DNA and protein are cross-linked) which can be used in the present method. In an alternative embodiment, the centrifugation step may be omitted, i.e. the following steps are performed directly after DNA shearing.

Immunoprecipitation

Once the proteins have been immobilized on the chromatin, the protein-DNA complex may then be immunoprecipitated. Hence, once the sample comprising chromatin has been prepared, the method preferably comprises a step of immunoprecipitating the chromatin. Preferably immunoprecipitation is carried out by addition of a suitable antibody against a protein of interest which may be present in the chromatin.

In one embodiment, the antibody may be immobilized on the rigid porous matrix, i.e. the antibody is the ligand which binds to the protein associated with the chromatin. In this embodiment, the protein associated with the chromatin is the protein of interest, e.g. which is bound to DNA in the chromatin.

In an alternative embodiment, an antibody free in solution is first applied to the chromatin-containing sample. Antibody-bound chromatin fragments may then be isolated using an agent which binds the antibody, the agent being conjugated to the rigid porous matrix. In this embodiment, the ligand bound to the rigid porous matrix may be any agent which binds the antibody, such as protein A, protein G or an anti-immunoglobulin (e.g. anti-IgG) antibody. The protein associated with the chromatin is the antibody specific for the protein of interest.

The antibody may bind to any protein associated with the chromatin. In one embodiment, the antibody is immunospecific for non-histone proteins such as transcription factors, or other DNA-binding proteins. Alternatively, the antibody may be immunospecific for any of the histones H1, H2A, H2B, H3 and H4 and their various post-translationally modified isoforms and variants. Alternatively, the antibody may be immunospecific for enzymes involved in modification of chromatin, such as histone acetylases or deacetylases, or DNA methyltransferases. Furthermore, it will be appreciated that histones may be post-translationally modified in vivo, by defined enzymes, for example, by acetylation, methylation, phosphorylation, ADP-ribosylation, sumoylation and ubiquitination of defined amino acid residues. Hence, the antibody may be immunospecific for any of these post-translational modifications.

Methods of Use

The present invention also relates to the use of the apparatus of the present invention to bind an analyte, typically chromatin, on the rigid porous matrix. The chromatin can then be eluted from the rigid porous matrix for subsequent analysis.

Therefore, the invention also comprises method of isolating chromatin from a liquid sample, comprising passing the liquid sample through a pipette tip according to the invention, such that the chromatin is retained on the rigid porous matrix in the pipette tip.

According to the present invention, liquid is capable of passing through the tip in both directions; typically, the application of reduced pressure causes the liquid sample to pass in one direction through the rigid porous matrix and the application of increased pressure causes the liquid sample to pass in the opposite direction through the rigid porous matrix.

In one embodiment of the method of the present invention, the liquid sample undergoes a single cycle through the rigid porous matrix, i.e. the liquid sample is drawn once through the lower end of the pipette tip by the application of reduced pressure and is expulsed once out of the lower end of the pipette tip by the application of increased pressure. It is preferred according to the method of the present invention that the liquid sample undergoes multiple cycling through the rigid porous matrix, i.e. that the liquid sample is drawn multiple times through the lower end of the pipette tip by the application of reduced pressure and is expulsed multiple times out of the lower end of the pipette tip by the application of increased pressure. In contrast to the methods of the prior art, the multiple cycling of the liquid sample through the rigid porous matrix provides multiple binding opportunities to the ligand immobilized on the rigid porous matrix, thereby allows greater volumes of chromatin to be loaded onto the rigid porous matrix. In this way, a dilute chromatin solution many times the pore volume of the rigid porous matrix can be drawn back and forth across the rigid porous matrix to maximise the adsorption of chromatin from the solution.

This method confers the further advantage that the chromatin be eluted from the rigid porous matrix with a smaller volume of eluent, thereby allowing a more concentrated chromatin solution to elute off the apparatus. In this way, an elution buffer similar in volume to the pore volume of the rigid porous matrix can be drawn up into the rigid porous matrix and then dispensed from it to maximise the concentration of the chromatin in the elution buffer.

Allowing the reagents and buffers to be drawn back and forth through the rigid porous matrix multiple times therefore improves the sensitivity and effectiveness of the immunoprecipitation process.

In one embodiment, the liquid sample is drawn through the lower end of the pipette tip in a manner such that no air enters the rigid porous matrix. In one embodiment, the liquid sample is drawn through the lower end of the pipette tip at a rate such that no air enters the rigid porous matrix. In one embodiment, the drawing of the liquid sample through the lower end of the pipette tip is terminated at a time such that no air enters the rigid porous matrix.

Using a pipette tip and aspirating back and forth such that no air enters the frit removes the foaming problem and so enables the process to be carried out without using centrifugation. This considerably improves the utility of the present invention, for an automated high throughput process.

Any suitable means of reducing and increasing pressure may be used for passing the liquid sample through the matrix. Preferably, the liquid sample may be drawn in through the matrix by a partial vacuum or a reduced pressure. The liquid sample may then be expulsed from the matrix under increased pressure. There is no particular limitation on the pressure at which the method of the present invention may operate. However, it is preferred that the driving force (increased pressure for the expulsion step or reduced pressure for the drawing-in step) is removed before air can be forced through the rigid porous matrix. The piston operated air displacement system used in most common laboratory pipettes using disposable tips works well for this method. However, positive displacement pipettes may work even better for this method, as the disposable tip contains the plunger, essentially allowing the device to operate as a micro-syringe where the plunger directly displaces the liquid, thereby providing the potential for the device to be used without air entering the rigid porous matrix.

In some embodiments, the liquid sample is incubated with the matrix for a suitable period, e.g. after adding the sample to the column and before withdrawing the sample from the column. According to the present invention, the ligand can bind to the chromatin after the liquid sample has incubated with the matrix for a period much shorter than the processes described generally in WO 2012/076882. This is because, in the method described in WO 2012/076882 the incubation is static; that is the sample liquid remains either within the pore structure of the rigid porous matrix or close enough to it to allow diffusion to move the analyte (especially chromatin) into the rigid porous matrix. In contrast, in the method preferred in the present invention, incubation is dynamic, in that the sample liquid is drawn continuously back and forth through the rigid porous matrix: it is this dynamic incubation which significantly reduces the incubation time compared with the method described in WO 2012/076882. Examples of incubation times range from 1 second to 1 hour, e.g. 2 seconds to 20 minutes, 5 seconds to 10 minutes, 10 seconds to 5 minutes, or 20 seconds to 2 minutes or about 1 minute. The length of this incubation may be varied in order to allow sufficient time for the ligand to bind to the chromatin, depending on the kinetics of this reaction.

The volume of the liquid sample may vary depending on the volume of the chamber in the column and the dimensions of the matrix (e.g. frit). The matrix is porous, and typically may have a porosity of around 0.5, i.e. about 50% of the total volume of the matrix is internal void space.

Washing

After passing the liquid sample through the matrix, in one embodiment the column is washed to reduce non-specific binding to the matrix. One or more wash steps may be employed, typically by adding a wash solution to the column and passing the wash solution through the matrix.

For example, the matrix may be washed with a high stringency buffer to eliminate non-covalent interactions. A high stringency buffer may contain e.g. 20-50 mM tris (hydroxymethyl)aminomethane (Tris)-HCl (pH 8.0), 1-5 mM ethylenediaminetetraacetic acid (EDTA), 0.1-0.5% sodium dodecyl sulphate (SDS), 0.5-1M NaCl, and 0.5-1% Triton X-100. Alternatively, the wash buffer may comprise PBS containing 0.5% of Tween-20, or 100 mM sodium phosphate containing 200 mM NaCl and detergents such as Tween-20 or Triton X-100. Typically the washing step may involve a series of buffers with varying stringencies, e.g. a low stringency buffer comprising a relatively low salt concentration and a high stringency buffer having a higher salt concentration.

Preferably the wash buffer comprises at least 0.1% SDS, more preferably about 0.2% SDS. In one embodiment, the method comprises 1, 2 or 3 wash steps, preferably 3 wash steps. Preferably the wash buffer comprises NaCl, with LiCl being less preferred.

Reversal of Crosslinking

In embodiments where the sample comprised crosslinked DNA-protein complexes, the crosslinking can be reversed after washing. The buffer for crosslink reversal can be optimized to maximize reversal of the crosslinks and minimize DNA degradation resulting from chemical, biochemical and thermodynamic action.

For example, in one embodiment the buffer for reversal of crosslinking comprises EDTA, SDS, and proteinase K, which should efficiently degrade proteins complexed with DNA and prevent degradation of DNA by nucleases such as DNAse I. A further buffer may also be used comprising sodium and potassium salts with a high concentration, e.g. sodium chloride at 1M or potassium chloride at 0.5 M. Such buffers have been demonstrated to efficiently reduce DNA degradation from chemical and thermodynamic action (Marguet, E. Forturre, P, Extremophiles, 2: 115-122, 1998) and increase the reversing rate of formaldehyde crosslinks. Typically reversal of crosslinking takes place at elevated temperature, e.g. 50-85° C. for 5 min-4 hours, preferably at 65-75° C. for 0.5-1.5 h.

Preferably, the chromatin bound to the matrix is first eluted from the pipette tip before reversal of crosslinking. In some embodiments of the present invention, the reversal of crosslinking step may take place within the pipette tip. Alternatively, the rigid porous matrix (e.g. in the form of a filter or frit) may be removed from the pipette tip (e.g. before or after washing) such that reversal of crosslinking takes place in a different vessel.

In one embodiment, the reverse crosslinking takes place on a column using a dynamic incubation method, by drawing the liquid continuously back and forth through the column, using reduced pressure to draw the liquid in one direction through the column and increased pressure to urge the liquid in an opposite direction through the rigid porous matrix. Without wishing to be bound by theory, it is believed that using such a dynamic incubation method may also reduce the incubation period for the reverse crosslinking.

DNA Capture and Analysis

Once reversal of the crosslinked DNA-protein complex is completed, DNA may be captured and cleaned. This may be achieved by the standard technique of phenol-chloroform extraction, or by capturing DNA on a further solid phase (e.g. silica or nitrocellulose in the presence of high concentrations of non-chaotropic salts).

Following the purification step, the DNA fragments isolated may then be analysed, and their identity determined. This is preferably achieved by the polymerase chain reaction (PCR). For example, the analysis step may comprise use of suitable primers, which during PCR, will result in the amplification of a length of nucleic acid. The term "PCR" includes all variants of the technique commonly known to the person skilled in the art, including allele-specific PCR, dial-out PCR, digital PCR, hot-start PCR, inverse PCR, ligation-mediated PCR, methylation-specific PCR, mini-primer PCR, multiplex PCR, nano-PCR, nested PCR, quantitative PCR (qPCR), reverse-transcription PCR, solid phase PCR, and touchdown PCR. The skilled person will appreciate that the method may be applied to detect genes or any region of the genome for which specific PCR primers may be prepared. The PCR results may be viewed, for example, on an electrophoretic gel. qPCR would provide quantitative analysis of the DNA present and is the preferred form of PCR for this method. Other techniques that could be used are direct sequencing of the DNA fragments or microarray hybridisation.

Applications

The present method may have a number of applications, including any of those for which ChIP assays are currently used, and may be applied to a wide variety of biological sample types. For instance, the method may be used in various research applications to characterize DNA/protein interactions. Variables such as histone protein modification, non-histone protein modification, and/or DNA methylation are key regulators of gene expression, and changes in them are associated with altered cell function or dysfunction, and hence disease. Since ChIP assays can be used to study variation in such epigenetic markers, the present method may be applied in diagnostic and prognostic applications and as a guide to appropriate treatment regimens.

Accordingly in one aspect the present method may be used for the diagnosis or prognosis of a disease condition. The method may be used, for example, in the diagnosis or prognosis of cancer, such as prostate, cervical cancer, or Hodgkin's lymphoma, and autoimmune diseases, such as rheumatoid arthritis. Preferably, the diagnostic method is carried out in vitro.

In one embodiment, the method may comprise taking first and second samples, and performing a ChIP assay according to the present method on each sample. For example, the first sample may comprise normal (a control) cells, and the second sample may comprise cells which are suspected to be diseased. By comparing the results of such an analysis, the method can be used to categorise a sample as being diseased or non-diseased.

Kits

Components for use in the present method may be provided in the form of a kit, optionally packaged with instructions for performing the method. Such kits may comprise, for example, a separation column as described above, and optionally one or more further reagents for performing a chromatin immunoprecipitation assay. Typical reagents for inclusion in the kit include one or more buffers or solutions for preparing the liquid sample, crosslinking chromatin, washing the matrix, reversal of crosslinks, and/or DNA purification.

FIG. 1A illustrates generally a spin column 10 according to the prior art. The column is provided with a frit 12; liquid 14 can be held in the frit and can flow through it in a single downward pass driven by centrifugation.

FIG. 1B illustrates generally a pipette tip 20 according to the invention; FIG. 1C providing an expanded view. The tip is provided, typically in its lower half (especially its lowest quarter) with a frit 22 which is formed of a rigid porous matrix through which liquid 24*a*, 24*b* may pass. In use, liquid may be held in the frit or drawn through it in either direction, reduced pressure being used to draw liquid in one direction through the tip so it passes through the frit; increased pressure being used to expel liquid in the other direction through the frit.

The invention will now be described with reference to the following non-limiting examples.

EXAMPLES

The spin column format was utilised for the ChIP assay described generally in WO 2012/076882 where a polyethylene sintered frit has been chemically oxidised and functionalised with either Protein A or Protein G. The frit size used in that column is approximately 7.4 mm diameter and 2 mm thick. The pore volume of these frits is approximately 40 μl.

In the experiments that follow a functionalised frit in a pipette tip or modified spin column was used to carry out a ChIP assay (using a pipette to force the liquids up and down through the frit): the results were compared with the ChIP assay described generally in WO 2012/076882 (using a centrifuge to force the liquids down through the frit). For comparison a product also formatted in a pipette tip (of the design described generally in US 2008/0119637) was used in a similar ChIP assay.

Materials

Chromatrap ChIP kit—CHIP100100

Rainin 200 μl Pipettor available from Mettler Toledo

Rainin 1000 μl pipettor available from Mettler Toledo

Rainin 1000 μl pipettor for Purespeed tips available from Mettler Toledo

Microcentrifuge—Fisher Scientific Accuspin micro 17R qPCR machine—BIORAD CFX Connect HepG2 Chromatin (Active Motif, 53019)

H3 Antibody (Active Motif, 61277)

Negative antibody—rabbit IgG, Sigma I5006

GAPDH Primers (human promoter region)—Sigma

Purespeed Pro A tips, Rainin PT-10-A20

Purespeed IP dilution solution: 16.7 mM tris(hydroxymethyl)aminomethane (Tris)-HCl (pH 8.0), 0.01% sodium dodecyl sulphate (SDS), 1.1% Triton-X100, 1.2 mM ethylenediaminetetraacetic acid (EDTA), 167 mM NaCl and 1 mM phenylmethylsulfonyl fluoride (PMSF)

Purespeed Equilibration buffer (44.4 mM Tris-HCl (pH 8.0), 4.1 mM EDTA, 0.04% SDS, 0.73% Triton-X100, 111 mM NaCl, 1 mM PMSF)

Purespeed Wash buffer 1 (50 mM Tris-HCl (pH 8.0), 2 mM EDTA and 1 mM PMSF)

Purespeed wash buffer 2 (100 mM Tris-HCl (pH 9.0), 500 mM LiCl, 1% NP40, 1% sodium deoxycholate and 1 mM PMSF)

Purespeed elution buffer (50 mM $NaHCO_3$ and 1% SDS)

Method

Comparator ChIP assays were carried out using the kit described generally in WO 2012/076882 which utilises the spin column format and followed the protocol from this kit.

ChIP assays according to the present invention were carried out using a small Protein A frit, 3.5 mm diameter×2 mm thickness, inserted into a 200 μl pipette tip or a Protein A frit, 7.4 mm diameter×2 mm thickness, inserted into a modified spin column. The end of the tip was cut off so the frit was as close to the end of the pipette tip as possible. Liquid was drawn up and down slowly within the pipette tip (manual operation) ensuring that no air entered the frit (one cycle). Each stage of the protocol is related to a fresh solution in a well, the solutions used and number of cycles were as follows:

200 μl pipette tip:

1. 150 μl distilled water×3 cycles
2. 150 μl Column conditioning buffer×3 cycles
3. 150 μl Column conditioning buffer×3 cycles
4. 150 μl water×3 cycles
5. 150 μl water×3 cycles
6. 100 μl lysate×20 cycles
7. 150 μl wash buffer 1×5 cycles
8. 150 μl wash buffer 2×5 cycles
9. 150 μl wash buffer 3×5 cycles
10. 150 μl water×6 cycles
11. 150 μl water×6 cycles
12. 100 μl elution buffer×20 cycles then expel liquid back into Eppendorf until bubbles are formed at the pipette tip.

Modified Spin Column 1. 300 μl distilled water×3 cycles
2. 300 μl Column conditioning buffer×3 cycles
3. 300 μl Column conditioning buffer×3 cycles
4. 300 μl water×3 cycles
5. 300 μl water×3 cycles
6. 100 μl lysate×20 cycles
7. 300 μl wash buffer 1×5 cycles
8. 300 μl wash buffer 2×5 cycles
9. 300 μl wash buffer 3×5 cycles
10. 300 μl water×6 cycles
11. 300 μl water×6 cycles
12. 100 μl elution buffer×20 cycles then expel liquid back into Eppendorf until bubbles are formed at the pipette tip.

The antibody:chromatin ratio in each experiment was 2:1. The eluted solutions were subjected to reverse cross-linking according the protocol described generally in WO 2012/076882. All samples were reverse cross-linked and analysed by qPCR using GAPDH primers.

Results

The pipetting stages took approximately 8-10 minutes to complete. Due to the short time period of this process there is less incubation time of the lysate, which contains the chromatin/antibody mixture, with the frit than for the process described generally in WO 2012/076882: less than a minute for lysate contact with the frit for the pipette tip method compared to 1 hour for the process described generally in WO 2012/076882 which requires centrifugation.

Experiment 1 (200 μl Pipetted Tip, 3.5 mm Diameter Frit)

500 ng chromatin/1000 ng antibody—according to the method of the invention. The results are shown in FIG. 2. Three reasonable replicates were achieved with good % Ab signal. The background of R2 was a little higher leading to lower % immunoprecipitation.

Experiment 2 (200 μl Pipette Tip, 3.5 mm Diameter Frit)

Figure 3:
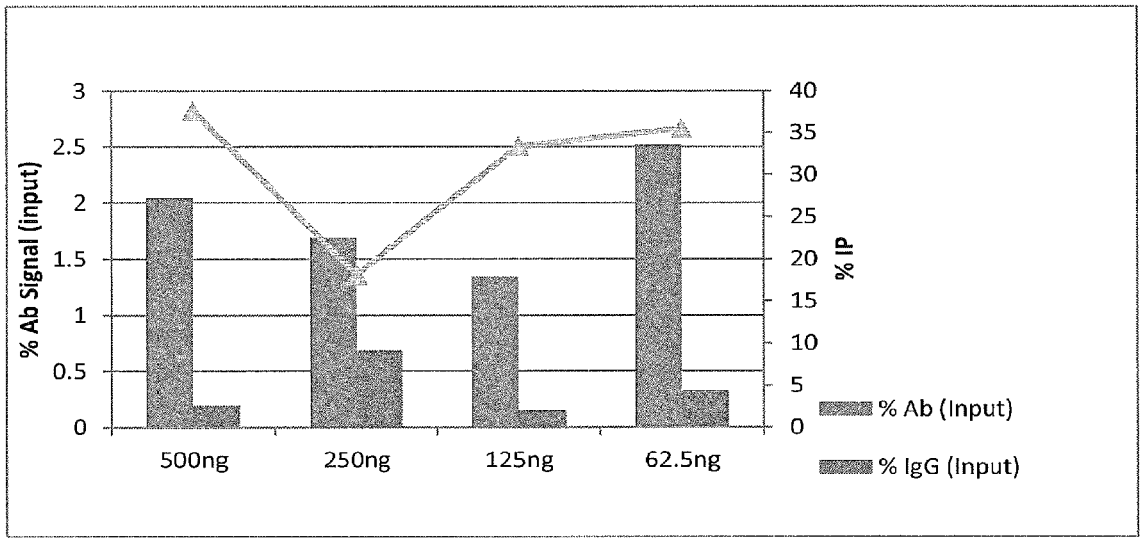
FIG. 3 illustrates chromatin dilution series for a chromatin-containing sample passing through 3.5 mm frits in a 200 μl pipette tip according to the invention.

Dilution series of chromatin, 500 ng, 250 ng, 125 ng, 62.5 ng (antibody loading 1000 ng, 500 ng, 250 ng, 125 ng respectively) were processed according to the method of the invention. The results are shown in FIG. 3. Good ChIP results were achieved: only the 250 ng chromatin had a slightly higher background which lowered the % immunoprecipitation result.

Experiment 3

The experiment was carried out in modified spin column (as described above) with a 7.4 mm diameter frit. This was carried out to replicate as closely as possible the frit size and type used in the methods described generally in WO 2012/076882, but in a modified 'tip'. It was carried out using 1000 ng chromatin and 2000 ng antibody. As a comparison, the same assay was also carried out in the standard spin column used in the methods described generally in WO 2012/076882 using centrifuge.

Figure 4:
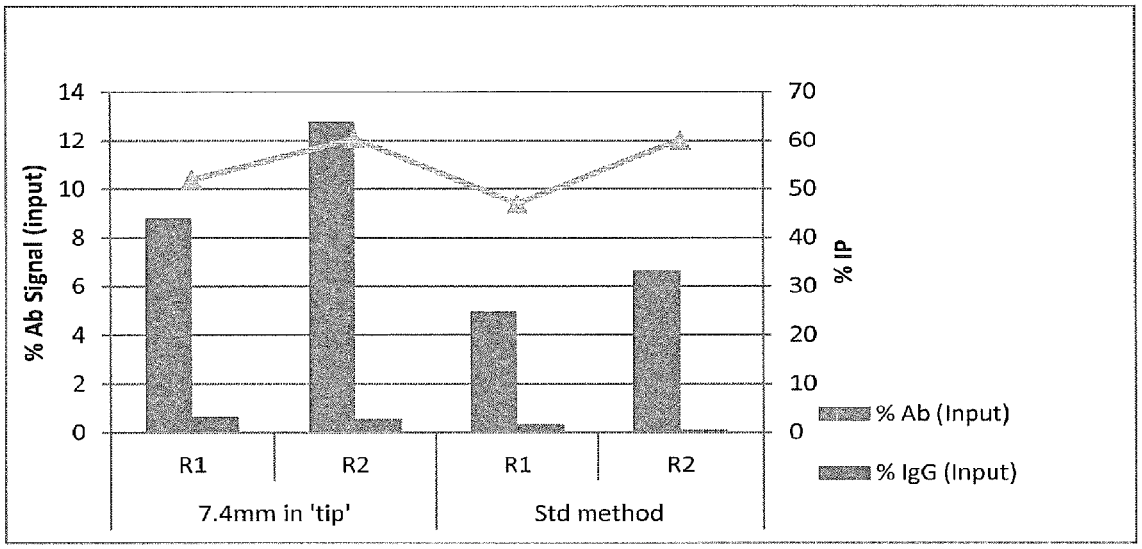
FIG. 4 illustrates a comparison between the results achieved using the method described in WO 2012/076882 and the method of the present invention using the same frit size and type.

The results are shown in FIG. 4. As can be seen, processing a 7.4 mm tip in a modified spin column using a pipettor gave better results than the standard centrifuge method in a spin column.

Experiment 4: Purespeed Pro A Tips

Purespeed Pro A tips (of the general design described in US 2008/0119637) were run according to the Rainin protocol, using the programmed method within the pipettor and Purespeed buffers, with 1000 ng chromatin and 2000 ng antibody. This was carried out to make a comparison to the methods described generally in WO 2012/076882 and the method of the invention.

No replication of DNA occurred at the qPCR stage for either positive or negative antibody.

The results show that the method of the invention has a much shorter protocol at the immunoprecipitation stage than standard ChIP methods and still gives good ChIP results over a range of chromatin additions. The much shorter contact time of the lysate with the functionalised frit in the method of the invention has not negatively affected the binding efficiency of the chromatin/antibody to the Protein A frits and surprisingly gives better results than the standard method. This may be due to more intimate contact of the chromatin/antibody with the ligands on the BioVyon being achieved. In addition, it is believed that the movement of liquid through the frit a number of times, as occurs in the method of the invention, may enhance the binding by replenishing the chromatin/antibody available at the inner surfaces of the frit as the liquid is moved. In the standard method described generally in WO 2012/076882 the lysate is added to the frit to just fill the pore volume and relies on diffusion only to provide the necessary contact. When directly compared to the standard method (utilising the same batch and size of frits) the results were improved with higher % antibody results for a much shorter protocol: this is a surprising result. The competitor product (Purespeed Pro A) failed to show a signal.

All publications mentioned in the above specification are herein incorporated by reference. Various modifications and variations of the described methods and system of the present invention will be apparent to those skilled in the art without departing from the scope and spirit of the present invention. Although the present invention has been described in connection with specific preferred embodiments, it should be understood that the invention as claimed should not be unduly limited to such specific embodiments. Indeed, various modifications of the described modes for carrying out the invention which are obvious to those skilled in chemistry, biochemistry, biology, materials science or related fields are intended to be within the scope of the following claims.

The invention claimed is:

1. A pipette tip having:

an open upper end adapted to engage a pipette;

an open lower end; and a through passageway in fluid communication with the upper and lower ends;

the pipette tip being configured such that, in use, a liquid sample is capable of passing through the tip both by being drawn in through the lower end by the application of reduced pressure, and being expulsed out of the lower end by the application of increased pressure;

the pipette tip containing a rigid porous matrix on which a ligand is immobilized, the ligand being capable of binding to a protein associated with chromatin;

the rigid porous matrix being positioned within the pipette tip such that, in use, chromatin in a liquid sample passing through the pipette tip is retained by the rigid porous matrix;

the rigid porous matrix being positioned within the lower half of the pipette tip;

wherein the rigid porous matrix comprises a sintered thermoplastic polymer, the matrix being functionalized at a surface after sintering, the functionalisation providing functional groups on the surface which facilitate the attachment of the ligand.

2. A pipette tip according to claim 1, wherein the rigid porous matrix is positioned within the pipette tip such that, in use, the liquid sample is capable of multiple passes through the tip, by multiple drawings through the lower end and multiple expulsions out of the lower end.

3. A pipette tip according to claim 1, wherein the rigid porous matrix is positioned within the lowest quarter of the pipette tip.

4. A pipette tip according to claim 1, wherein the rigid porous matrix is in the form of a filter disc or frit.

5. A pipette tip according to claim 1, the cross-sectional area of the pipette tip narrowing towards the lower end thereof.

6. A pipette tip according to claim 1, the pipette tip being tapered towards the lower end thereof.

7. A pipette tip according to claim 1, having a frusto-conical or frusto-pyramidal shape.

8. A pipette tip according to claim 1, having a volume of 1 μl to 10 ml.

9. A pipette tip according to claim 1, having a volume of 5 μl to 1 ml.

10. A pipette provided with a tip according to claim 1.

11. A pipette according to claim 10, wherein the tip is an integral part of the pipette.

12. A pipette according to claim 10, wherein the tip is manufactured separately from the pipette and attached to the pipette prior to use.

13. A pipette according to claim 10, selected from the group consisting of an air displacement pipette, a positive displacement pipette, a multichannel pipette, a pipetting syringe, a glass micropipette, a microfluidic pipette, a microsyringe, a syringe and a cannula.

14. A kit comprising a pipette tip as defined in claim 1, and one or more buffers, solutions or reagents suitable for performing a chromatin immunoprecipitation assay.

* * * * *